United States Patent [19]

Membrino

[11] Patent Number: 4,500,000

[45] Date of Patent: Feb. 19, 1985

[54] PAD OF PLASTIC BAGS WITH SUPPORT MEANS

[76] Inventor: Hercules Membrino, 280 Paoli Pike, Malvern, Pa. 19355

[21] Appl. No.: 588,567

[22] Filed: Mar. 12, 1984

[51] Int. Cl.[3] ..... B65D 85/62; B65D 30/00

[52] U.S. Cl. ..... 206/554; 206/526; 206/806

[58] Field of Search ..... 206/449, 494, 554, 526, 206/806

[56] References Cited

U.S. PATENT DOCUMENTS

| | | | |
|---|---|---|---|
| 401,233 | 4/1889 | Wheeler | 206/806 |
| 2,982,398 | 5/1961 | Makrauer | 206/526 |
| 3,285,407 | 11/1966 | Abramson | 206/526 |
| 3,862,687 | 1/1975 | Pirman | 206/806 |
| 4,406,371 | 9/1983 | Membrino | 206/526 |
| 4,420,082 | 12/1983 | Bernie | 206/526 |

FOREIGN PATENT DOCUMENTS

| | | | |
|---|---|---|---|
| 2657395 | 6/1978 | Fed. Rep. of Germany | 206/806 |
| 1008293 | 10/1965 | United Kingdom | 206/554 |

*Primary Examiner*—William T. Dixson, Jr.
*Assistant Examiner*—Brenda J. Ehrhardt
*Attorney, Agent, or Firm*—Arthur A. Jacobs

[57] ABSTRACT

A pad of plastic open-mouthed pockets overlying each other and separably connected by a common base portion, the base portion being formed of selvage portions extending from the open mouth of the pockets and being secured together at the sides thereof and at spaced connections at the free edges thereof, and a support hanger secured to the base portion and having an extension extending beyond the base portion in a position to be secured to a surface, the pockets being individually separable from said base portion to form individual bags.

10 Claims, 4 Drawing Figures

FIG. 1
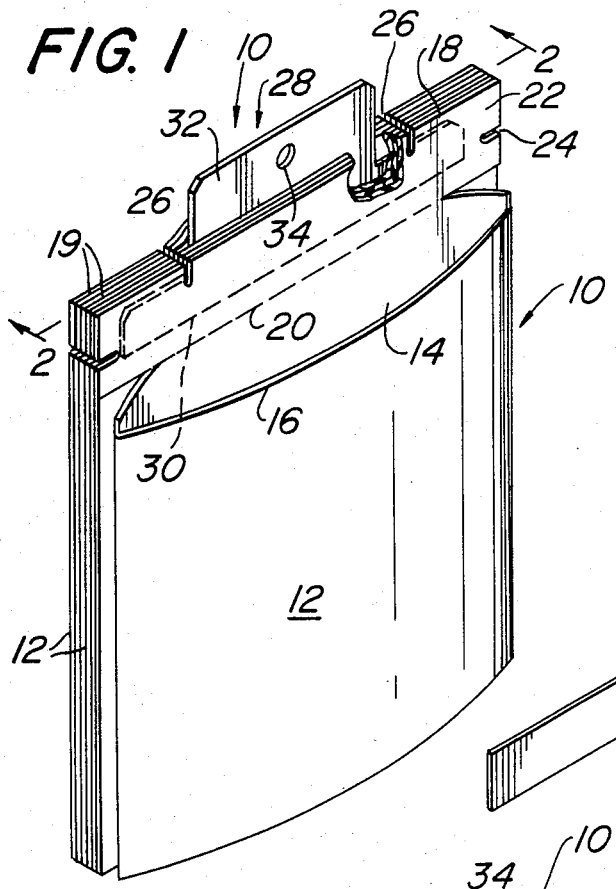
FIG. 3
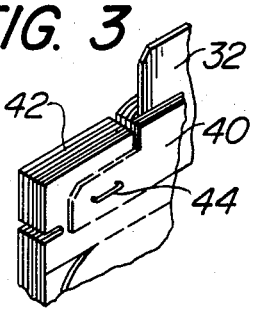
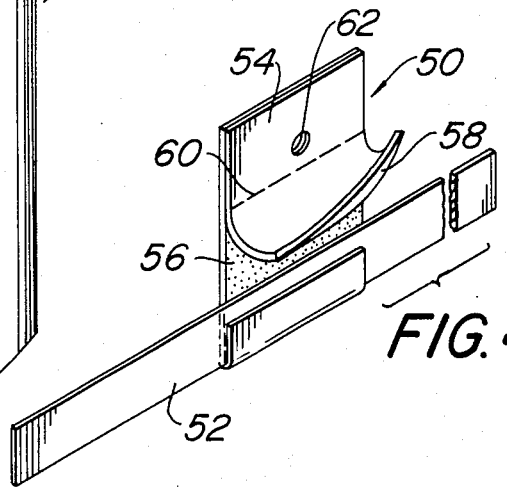
FIG. 4
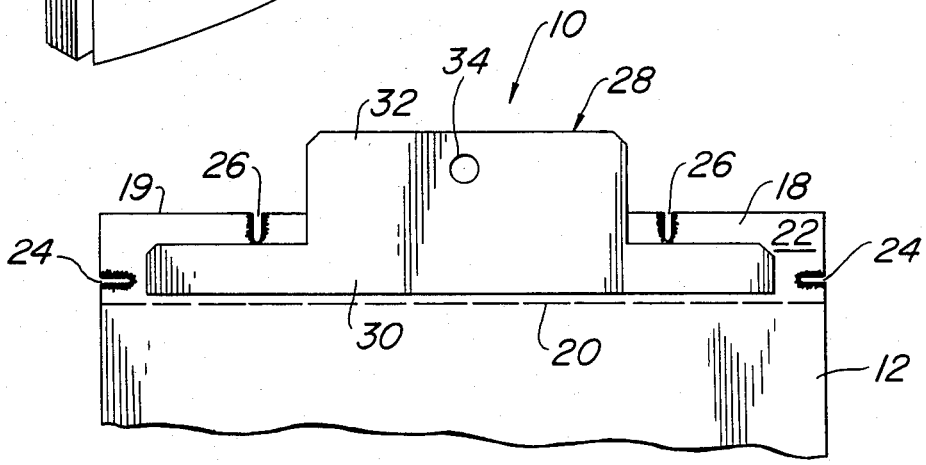
FIG. 2

PAD OF PLASTIC BAGS WITH SUPPORT MEANS

This invention relates to plastic bags, and it particularly relates to packs or pads comprising a plurality of plastic bags having support means to permit individual bags to be removed from the pad while retaining the pad in fully supported position.

The pad of bags utilized in the present invention is similar to that disclosed in applicant's prior U.S. Pat. No. 4,406,371, issued Sept. 27, 1983, and comprises layers of individual bags which are welded or otherwise secured together at a selvage portion, the bags being individually separable from the salvage portions.

The pad of bags disclosed in the aforesaid U.S. Pat. No. 4,406,371 was constructed to be held by the fingers or on a flat base plate while the bags were separated. However, it has been found that when held by the fingers, it is somewhat difficult to get a clean easy breaking away of the individual bags because of a lack of adequate support to serve as a counterforce. The flat bed, while serving as a support, not only limited the manner in which the pad could be used but did not provide the sort of internal support for the pad which, it has been found, is required for the most efficient utilization of the pad. Furthermore, not only was it difficult to load or fill a bag without first removing it from the pad, but if it was not removed, the connecting lug would tend to interfere with both the opening and the loading of the bag. It was also found that when using either the fingers or the flat bed with its upstanding connecting lug, there was no support for the ends of the selvage portion so that when a bag was pulled, it often did not break away cleanly.

It is, therefore, an object of the present invention to overcome the above and other disadvantages by providing a pad of bags with a support means that permits the pad to be used either vertically or horizontally, which provides a firm and secure internal support for the pad throughout the selvage portion, and which permits easy loading of an individual bag while it is still held in position by the support means.

Another object of the present invention is to provide a pad of bags with a support means that is either self-supporting or attachable to a surface by external means.

Another object of the present invention invention is to provide a pad of bags with a support means that is extremely simple in construction, inexpensive to make and easily used.

Other objects and many of the attendant advantages of this invention will be readily appreciated as the same becomes better understood by reference to the following description when read in conjunction with the accompanying drawings wherein:

FIG. 1 is a perspective view of a bag pad and support assembly embodying the present invention.

FIG. 2 is a sectional view of the assembly of FIG. 1 taken on line 2—2 of FIG. 1.

FIG. 3 is a fragmentary perspective view showing a modified form of the invention.

FIG. 4 is a perspective view showing a modified form of support means.

Referring in greater detail to the drawings wherein similar reference characters refer to similar parts, there is shown in FIG. 1 a bag pad assembly, generally designated 10, comprising a series of plastic bag pockets 12, each of which has an open mouth 14 defined at its front by a free edge 16 forming the upper edge of the front wall of the pocket—which becomes an individual bag when separated from the pad. The rear wall 18 of the pocket extends beyond the edge 16 of the front wall and has an upper edge 19. A score line 20 extends from edge to edge of the rear wall and defines the upper edge of the rear wall of the bag which is formed by the pocket after it is torn away from the pad along the score line. The area between the score line 20 and the upper edge of the wall 18 constitutes a selvage portion 22.

All of the selvage portions 22 are welded together at their opposite ends, as shown at 24 and are also provided with oppositely positioned welds 26 at their upper edges. The welded-together selvage portions combine to form a base portion for the pad. Other connecting means may be used but the welds are preferred.

The above-described construction is like that shown in the aforesaid U.S. Pat. No. 4,406,371. However, whereas the base portion in the pad of that patent is provided with a slit to receive the fingers of a hand or a lug on a flat bed, the base portion of the present invention is devoid of such slit which, in itself, forms a weakness in the base. Instead, there is provided a hanger support, generally designated 28.

The hanger 28 may be made of any desired relatively rigid material such as cardboard, metal, wood, plastic, or the like. It comprises a straight, longitudinal section 30 having an upstanding central flange 32. The central flange may be integral with the straight section or it may be made of any other desired material, flexible or rigid. The hanger 28 shown in FIGS. 1 and 2 is provided with an aperture 34 for receiving a hook, nail, screw or any other corresponding hanging means.

The hanger 28 is inserted between any pair of pockets 12, but preferably in the central portion of the pad for best support. When so inserted, the flange 28 is positioned between the welds 26 so that the flange extends, between a pair of pockets, upwardly of the base portion of the pad while the welds 26 bear against the upper edge of the straight section 30. The welds 26 thereby perform several functions, namely they serve as stop means for the hanger when the device is hung in a vertical position, they serve to align the hanger in a straight horizontal position when the device is hung up, and they serve as horizontal stops to prevent the flange 32 from moving out of position. The welds 24 at the sides act as stops to prevent undue movement of the straight section in the horizontal plane.

In addition to being capable of hanging in the vertical position, the device may also be placed in a horizontal position if so desired.

FIG. 3 shows a modified form of the device wherein the hanger 40 is secured to the base portion 42 by a staple 44, the staple going through all the selvage portions forming the base. A similar staple is provided for the opposite end of the hanger (not shown). Any number of staples can be used. It is also possible to substitute any other type of feasible securing means such as adhesives, clips, screws, rivets, etc., depending on the material of which the hanger is made. This type of fastening means is especially desirable where the hanger is heavy, such as where it is made of metal or the like.

It is further possible,, when using such staples or other securing means, to attach the straight, longitudinal section of the hanger to one of the outer surfaces of the base portion, instead of between a pair of pockets.

The modification in FIG. 4 is a hanger, generally designated 50, which is similar to hanger 28 in that it has a straight section 52 of the same type of relatively rigid material. However, instead of an integral rigid flange, it is provided with a flexible tab 54 which is provided with an adhesive face 56 having a removable covering 58 that is removable by tearing away on a score line 60. Above the score line 60 the tab is provided with an aperture 62. In this manner, the hanger can either be self-adhered to a supporting surface by the adhesive 56 or it can be connected by a nail, hook, screw, or the like extending through aperture 52.

In essence, the elimination of the slit makes the device more sturdy while the construction of the hanger permits it to coact with the welds not only to perform the function of the fingers or the lug on the flat bed as a supporting means, but to permit it so accomplish such support in a vertial direction—which could not be accomplished by the lug on the flat bed. In addition, the hanger of the present invention, especially in its rigid straight section, serves as an internal support for the base portion somewhat in the fashion of a wire frame for an umbrella.

The invention claimed is:

1. A pad of plastic open-mouthed pockets overlying each other and separably connected by a common base portion, said base portion being formed of selvage portions extending from the mouths of said pockets, said selvage portions having free edges in spaced parallel relation to the mouths of their respective pockets and side edges in common with the side edges of said pockets, said selvage portions being secured together by common side securing means at the side edges thereof and by common free edge securing means at the free edges thereof, a support hanger having a substantially longitudinal section and an extension projecting transversely therefrom, said longitudinal section being positioned to abut said free edge securing means to prevent movement thereof in a direction toward said free edges, said side edge securing means preventing lateral movement of said longitudinal section when it is so positioned, and said extension being positioned to by-pass said free edge securing means to project beyond said free edges when said longitudinal section is in abutment with said free edge securing means.

2. The pad of claim 1 wherein said extension is substantially rigid.

3. The pad of claim 1 wherein said extension is substantially flexible.

4. The pad of claim 1 wherein said extension is provided with adhesive to make it self-adhering to a support surface.

5. The pad of claim 1 wherein said extension is integral with said longitudinal section.

6. The pad of claim 1 wherein sid longitudinal section and said extension are made of dissimilar materials.

7. The pad of claim 1 wherein said longitudinal section is substantially rigid and said extension is substantially flexible.

8. The pad of claim 1 wherein said longitudinal section is positioned between a selected pair of said pockets and abuts said spaced connection to hold said longitudinal section in place.

9. The pad of claim 1 wherein said side securing means are welds.

10. The pad of claim 1 wherein said free edge securing means are welds.

* * * * *